US005222454A

United States Patent [19]

Meyer

[11] Patent Number: 5,222,454

[45] Date of Patent: Jun. 29, 1993

[54] HYBRID HYDROFOIL INTERFACE WITH WET WELL DECK

[75] Inventor: John R. Meyer, Derwood, Md.

[73] Assignee: The United States of America as represented by the Secretary of the Navy, Washington, D.C.

[21] Appl. No.: 920,731

[22] Filed: Jul. 28, 1992

[51] Int. Cl.[5] ..... B63B 21/56

[52] U.S. Cl. ..... 114/259

[58] Field of Search ..... 114/242, 248, 249, 250, 114/251, 61, 258, 259, 26, 36, 37, 274

[56] References Cited

U.S. PATENT DOCUMENTS

| | | | |
|---|---|---|---|
| 2,359,549 | 10/1944 | Epstein | 114/248 |
| 3,631,829 | 1/1972 | Kamph | 114/259 |
| 3,659,546 | 5/1972 | Miklos | 114/248 |
| 3,943,875 | 3/1976 | Sanders | 114/259 |
| 3,973,512 | 8/1976 | Fahrner | 114/248 |
| 4,020,777 | 5/1977 | Brown et al. | 114/258 |
| 4,084,527 | 4/1978 | Hellmich | 114/36 |
| 4,389,960 | 6/1983 | Fletcher | 114/248 |
| 4,702,189 | 10/1987 | Schlichthorst | 114/61 |

FOREIGN PATENT DOCUMENTS

| | | | |
|---|---|---|---|
| 2511969 | 3/1982 | France | 114/258 |

OTHER PUBLICATIONS

John R. Meyer "Hybrid Hydrofoil Technology Applications" Jun. 24–27 1992.

*Primary Examiner*—Jesûs D. Sotelo
*Assistant Examiner*—Stephen P. Avila
*Attorney, Agent, or Firm*—Charles D. Miller

[57] ABSTRACT

Bottom panels of a wet well structure of a vessel are shaped to enclose the single strut of a smaller vessel of hybrid hydrofoil design such that the pod and foils of the hybrid hydrofoil protrude from between the bottom panels. Inflatable seals allow the wet well to be drained and the smaller vessel supported within the wet well by solid or inflatable blocks to secure the smaller vessel and for repair, reprovisioning and the like. The motive power system of the smaller vessel can also be used to provide auxiliary power for the larger vessel.

8 Claims, 2 Drawing Sheets

HYBRID HYDROFOIL INTERFACE WITH WET WELL DECK

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention generally relates to the design of hulls for watercraft and, more particularly, to hull structures of vessels allowing docking together or joint functioning of vessels.

2. Description of the Prior Art

Waterborne vessels have been used since ancient times and for many purposes and particularly for the transport of large objects or heavy cargoes. The need for vessels to perform in a variety of water and weather conditions and the various purposes for which such vessels have been intended has led to a great variety of hull designs. In particular, the often conflicting desire to increase both the speed and operational range of vessels has led to the development of hydrofoil designs.

Hydrofoils function to increase speed by decreasing the wetted area of hulls by producing lift sufficient to support the main hull of a vessel above the water and, in general, have been relatively successful for passenger service and the transporting of relatively light loads. However, the need to generate sufficient lift to entirely replace displacement as a means for supporting the vessel requires relatively high speeds which increases fuel consumption and reduces the range of the vessel. Fuel efficiency of such vessels was often compromised since the propulsion arrangement must serve both hullborne and foil-borne modes of operation and thus cannot be optimized for either. This has led to dual propulsion systems for each of the hull borne and foil borne modes of operation. However, dual propulsion systems are not fully optimize efficiency since the necessarily involve additional weight. Further, the structure required to produce such lift increases with the displacement of the vessel and the size of vessels to which hydrofoils can be applied has, as a practical matter, been relatively limited.

As an alternative for the purpose of extending the potential of hydrofoils to larger vessels, the so-called hybrid hydrofoil concept has drawn substantial interest in recent years. This type of design uses one or more submerged hulls or pods connected to the vessel by one or more struts as a structural base upon which hydrofoils can be mounted. The pod can be used to carry fuel and/or motive power systems and preferably provide some positive static buoyancy for the vessel. By providing a significant amount of support for the vessel by the static buoyancy of the pod, the hydrofoils are thus required to provide less dynamic lift, often only on the order of 30%–70% of the displacement of the entire vessel. The provision of podded propulsion through the submerged hull is advantageous since the podded hull will always be submerged.

A particular design for a hybrid hydrofoil configuration has included a single pod with counter-rotating propellers (possibly co-axial) connected to the displacement hull of the vessel by a single narrow strut running a substantial portion of the length of the vessel. Other designs include a single propeller on the stern of the pod. Two pair of foils, each equipped with flaps for producing lift and dynamic stabilization of the vessel are provided near the fore and aft ends of the pod. Unflapped foils using incidence control can also be applied. By the combination of providing a portion of the vessel support through the static buoyancy of the pod and strut and merely using the foils to lift the displacement hull from the water, reducing wetted area of the combination hull of the vessel, the latitude of operating conditions has been increased while efficiency and range have been increased while the speed of hydrofoil designs has been maintained. Additionally, it should be understood that even if the entire pod is filled with fuel, such fuel is typically less dense than water and substantial static buoyancy can be obtained essentially from additional fuel-carrying capacity in the hybrid hydrofoil design. Further, since less than the total vessel weight must be provided as dynamic lift from the hydrofoils, the hybrid hydrofoil concept can be applied to vessels of greater displacement than conventional hydrofoil designs.

Also, in recent years, many vessels of extremely large size have been built for particular purposes, such as Aircraft carriers. Another type of large vessel is the so-called Carrier of Large Objects (CLO) which typically includes a wet-well to allow a large object, such as a barge, to be carried into the wet well while afloat. The CLO thus can provide increased efficiency of transportation of the object by enclosing the floating object in a more efficient hull shape. The CLO can also serve to transport smaller vessels of limited range such as air cushion vehicles and surface effect ships. However, the size of a CLO limits its top speed and maneuverability. Further, the wet well can be drained to more completely support the object or allow repair and servicing thereof. Thus a CLO can provide a facility for refueling or refitting of smaller vessels at sea and while under way.

However, the dimensions of the wet well of a CLO are, of course, limited and cannot generally accommodate the overall height of a relatively large hybrid hydrofoil hull vessel in the hullborne mode of support. Further, the hydrofoil structure protruding from the submersible hull would be subject to damage even if the hybrid hydrofoil hull could be accommodated inside the CLO. Support for the entire hybrid hydrofoil vessel would also be difficult and might preclude draining of the CLO wet well during transport thereof.

SUMMARY OF THE INVENTION

It is therefore an object of the present invention to provide a structure for the wet-well of a CLO which allows a hybrid hydrofoil to be carried thereby.

It is another object of the present invention to provide a method and means of combining a hybrid hydrofoil hull design and a CLO in a manner which will allow the increase of top speed of a CLO.

It is a further object of the invention to provide a structure for the wet well of a CLO which will accommodate a plurality of different hybrid hydrofoil hull geometries.

It is yet another object of the present invention to provide a wet well structure for a vessel which can be drained while enclosing a hybrid hydrofoil hull of greater draft than the depth of the wet well.

In order to accomplish these and other objects of the invention, a wet well structure for a vessel is provided including a closable opening in a side of the wet well, at least two movable panels for opening and closing a portion of a bottom area of the wet well, opposing edge portions of said at least two panels defining an elongated opening therebetween, and an inflatable seal attached to the opposing edge portions of the at least two movable panels.

In accordance with another aspect of the invention, a method of providing motive power for a vessel having a wet well structure is provided including the steps of enclosing another vessel within the wet well with the propulsion system of said another vessel extending between panels forming a bottom of said wet well, activating said propulsion system of said another vessel, and transferring force from said another vessel top said vessel having said wet well.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 2:
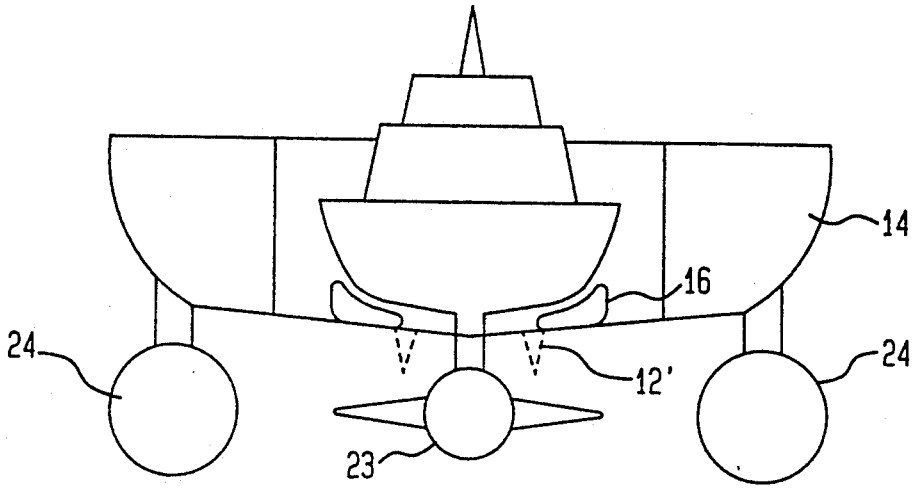
FIG. 2 is a view of the stern of a CLO including a hybrid hydrofoil within the wet well thereof.

Referring now to the drawings, and more particularly to FIG. I, there is shown a simplified view of a wet well of a carrier of large objects (CLO) 10. As alluded to above, a CLO is a large vessel having a portion 20 of the hull designed to be opened to the surrounding water. This portion 20 is commonly referred to as a wet well. The wet well 20 is surrounded by sides 14 of the CLO structure in order to provide buoyancy for the structure of the wet well portion of the CLO. The bottom of the wet well is closable by doors such as retractable (e.g. telescoping) panels 12. An alternate structure in the form of accordion doors 12' is shown in FIG. 2. However, it is to be understood that the mechanism by which the CLO hull bottom can be closed is relatively unimportant to the practice of the invention and many other mechanisms would be suitable for use therein. Generally speaking, it is desirable to be able to open as much of the bottom of the wet well as possible to accommodate such uses as salvage operations and the like. However, as will be discussed in more detail below, this is not required for the purposes of the present invention.

Figure 1:
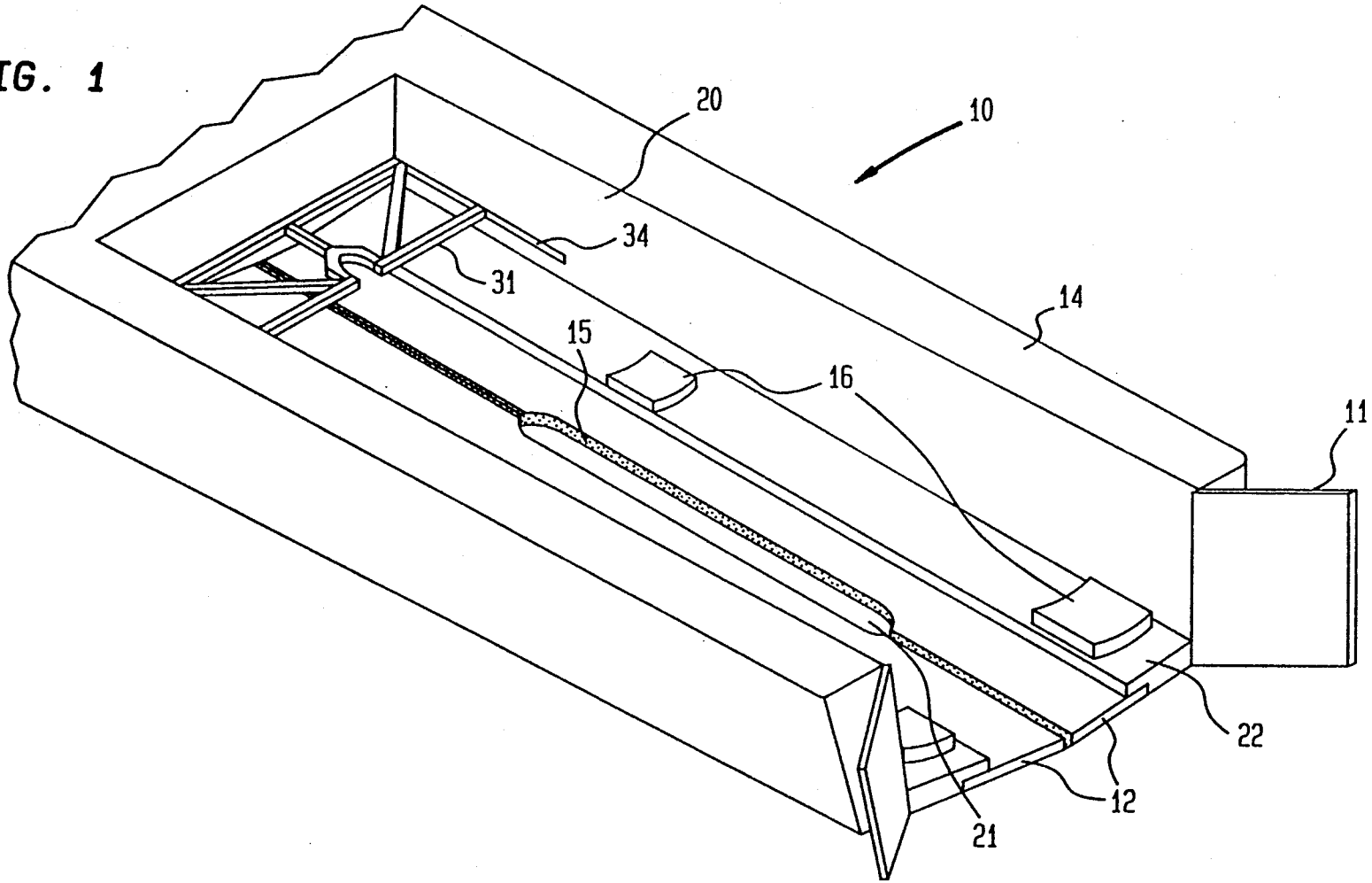
FIG. 1 is a perspective view of the wet well of a CLO including a structure in accordance with the present invention.
Figure 3:
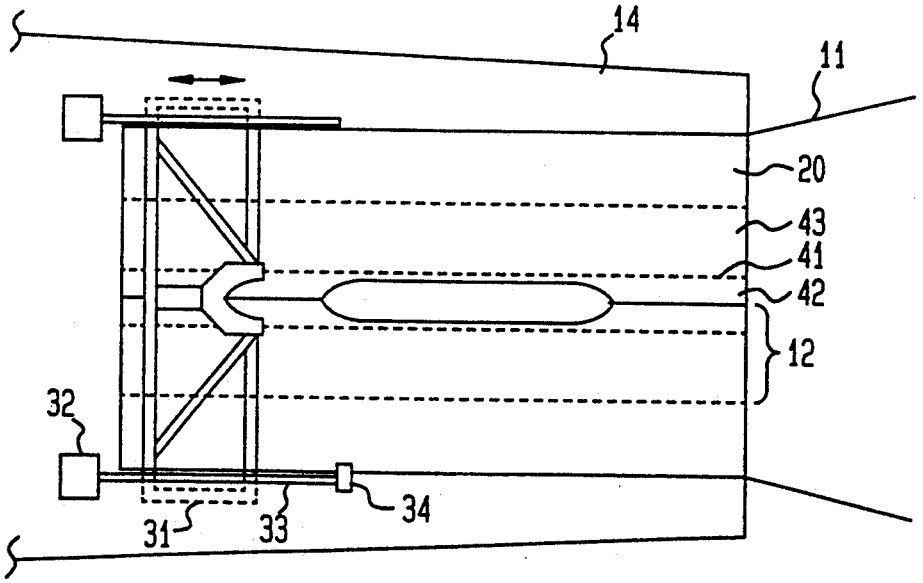
FIG. 3 is a top view of a wet well of a CLO.

At least one side of the wet well, typically in the stern of the CLO can also be opened to the surrounding water by means of other movable panels, depicted as doors 11 in FIGS. 1 and 3. These doors or movable panels preferably provide for an opening of substantially the full width of the wet well to allow large objects to be moved into the CLO while afloat. Then, when the bottom panels 12 and the doors 11 are closed, the CLO effectively provides a streamlined hull around the large object to enable efficient transportation thereof. It should also be noted that once the doors and bottom panels of the wet well have been closed, seals provided thereon allow water to be pumped from the wet well if desired in order to reduce the weight and draft of the CLO and to provide for structurally securing the large object during transportation.

While the wet well of a CLO is thus able to transport many large objects of various shapes, a vessel of the hybrid hydrofoil design is singularly difficult to accommodate with such a structure. The principal reason is that such a vessel must enter the CLO in the hull-borne mode of operation at speeds where no significant dynamic lift of the hybrid hydrofoil hull is available. Thus the draft of the hybrid hydrofoil vessel typically exceeds the depth of water in the wet well. Even if that were not the case, the hybrid hydrofoil structure would make the vessel difficult to secure within the wet well and difficult to support if the wet well were to be drained. Further, the hybrid hydrofoil pod with controllable hydrofoils extending therefrom would be subject to damage from contact with the interior of the wet well.

However, it is nevertheless very desirable to do so because of the desirability of keeping weight to a minimum aboard such vessels. Therefore, while the range of vessels of hybrid hydrofoil design is substantial, voyages of long duration are not practical in view of the stores, crew requirements and the like. Accordingly, when such vessels are to be stationed at sea, it is preferable to operate them from another larger vessel from which relatively short duration voyages may be made. A CLO thus is seen to be a highly desirable platform for such operations, particularly if the wet well could be drained in order to effect repairs of the hybrid hydrofoil vessel as may become necessary from time to time.

Therefore, in accordance with the invention, the wet well of the CLO is fitted with bottom doors having their closing edges shaped to leave an opening 21 to accommodate the single strut of the hybrid hydrofoil design discussed above. The edges of the bottom doors are also fitted with inflatable seals 15 to fit tightly against this strut when the hybrid hydrofoil vessel has been otherwise secured in the wet well. These inflatable seals 15 should preferably be sufficiently expandable, upon inflation, to allow closure of the bottom of the CLO even when no structure is positioned in opening 21 in order to allow draining of the wet well under any conditions.

When a vessel is secured within the wet well and the bottom panels 12 and stern doors 11 are closed and the seal 15 sufficiently inflated to form a substantially water tight seal, the wet well can be drained, allowing the enclosed vessel to settle to the bottom of the wet well. Damage to the hull of the vessel can be avoided by providing solid or inflatable blocks 16 to distribute the vessel weight over a substantial area of the bottom of the wet well and also the hull of the enclosed vessel. In this regard, it should be noted that it is preferable to provide supports, possibly in the form of a stationary frame within the wet well for supporting the inflatable blocks which, in turn, support the vessel. For this purpose, it is considered preferable that some portion 22 of the wet well bottom be fixed and non-movable in order to provide such support and to thus prevent the weight of the enclosed vessel from bearing on movable panels 12 or doors 12'. In this regard and as an incident of design of the wet well of a CLO specific to accommodation of hybrid hydrofoil vessels, it is only necessary that the bottom panels or doors be opened to a dimension which provides some working clearance around the strut of the hybrid hydrofoil. By the same token, the doors or movable panels may be used to accurately locate the enclosed vessel axially within the wet well by effectively grasping the strut between the panels. It is therefore desirable that hydraulic or electrical mechanisms be provided for closing the doors or panels 12 which are capable of applying a substantial additional force against the strut.

With a hybrid hydrofoil design vessel enclosed in a wet well of a CLO, as shown in FIG. 2, the wet well drained and the hybrid hydrofoil main hull supported by solid or inflatable blocks 16, it is seen that the hybrid hydrofoil pod 23 is aligned with the podded propulsion system 24 of the CLO. It may also be observed that the draft of the CLO is not generally increased since the diameter of the hybrid hydrofoil is less that the diameter of the podded propulsion system 24 of the CLO owing to the difference in size of the vessels. It should be noted that a podded propulsion system is preferred for the CLO because of the reduced effect of wave action thereon and also to avoid structures directly below the wet well.

So located, pod 23 could be used provide additional propulsion power for the CLO. However, since the power available from the hybrid hydrofoil vessel may be substantial, it is not desirable to transfer force from the enclosed vessel to the CLO through the movable panels 12 or doors 12''. While the strut of the hybrid hydrofoil is necessarily capable of carrying such forces, the structure allowing the doors or panels to be moved may not be able to bear such loads without the use of otherwise objectionable strengthening arrangements. Accordingly, it is considered preferable to provide a yoke 31 to receive the leading edge of the hybrid hydrofoil strut and to thus provide for transfer of forces from the enclosed vessel to the CLO.

Preferably yoke 31 is provided with tracks allowing fore and aft movement of the yoke. Which runs on tracks 33. These tracks also preferably include some structure such as long threaded rods or chains to move the yoke 31 against the strut. Power is preferably provided by electric motors 32 but other mechanisms such as hydraulic arrangements could also be used. Threaded rods are considered particularly desirable since substantial force can be applied to the yoke (to assist in locating and securing the enclosed vessel) with a relatively small motor, with or without intervening gearing. The aft ends of the threaded rods could thus be carried in thrust bearings 34 allowing force to be transferred from the enclosed vessel to the CLO through a structure maintained solely in tension. Alternatively, however, some other arrangement such as pins or wedges can be provided for locking the yoke in an operative position against the hybrid hydrofoil strut and transferring force to the CLO. It should also be understood that the use of power from the hybrid hydrofoil is not limited to provision of additional power but could be used alone to provide accurate maneuvering of the CLO at low speed or simply as an auxiliary power source.

As a further possible structure of the bottom panels 12 of the wet well and which may simplify the structure of the inflatable seal 15, FIG. 3 shows a modification of panel 12 by dividing it into two portions 42 and 43 generally at line 41. these panels 42 and 43 could be hinged together but are preferably configured so that auxiliary panel 42 may be telescoped within or retracted adjacent to main panel 43. Panel 43 is preferably of such dimensions as to be able to meet the opposite panel 43 and fully close the bottom of the wet well without reliance on panel 42 which would only be used to accommodate the strut of a hybrid hydrofoil vessel. If this is done, it is not necessary to provide for inflatable seal 15 to be inflatable to a degree to accomplish closure of the bottom of the wet well even in the absence of a strut.

In view of the foregoing, it is seen that the invention provides for the accommodation of a vessel of hybrid hydrofoil design within a wet well of a larger CLO-type vessel and additionally provides for the joint functioning thereof to achieve increased speed of the CLO. The particular arrangement permits draining of the wet well of the CLO and for proper support of the enclosed vessel when the wet well is drained.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A wet well structure for a vessel including a closable opening in a side of said wet well at least two movable panels for opening and closing a portion of a bottom area of said wet well, opposing edge portions of said at least two panels defining an elongated opening therebetween, and an inflatable seal attached to said opposing edge portions of said at least two movable panels.

2. A wet well structure as recited in claim 1, wherein said at least two panels are retractable.

3. A wet well structure as recited in claim 2, wherein said at least two panels are telescoping.

4. A wet well structure as recited in claim 1, wherein said at least two movable panels are hinged at a bottom surface of said vessel.

5. A wet well structure as recited in claim 1, wherein said elongated opening is of approximately the dimensions of a cross-section of a strut of a hybrid hydrofoil vessel.

6. A wet well structure as recited in claim 1, further including means for supporting a main hull of a vessel within said wet well.

7. A wet well structure as recited in claim 6, wherein said means for supporting a main hull of a vessel within said wet well comprises inflatable blocks.

8. A wet well structure as recited in claim 6, wherein said means for supporting a main hull of a vessel within said wet well comprises solid blocks.

* * * * *